US009627760B2

(12) United States Patent
Tsubaki

(10) Patent No.: US 9,627,760 B2
(45) Date of Patent: Apr. 18, 2017

(54) ANTENNA DEVICE AND WIRELESS COMMUNICATION APPARATUS

(71) Applicant: Murata Manufacturing Co., Ltd., Nagaokakyo-shi, Kyoto-fu (JP)

(72) Inventor: Nobuhito Tsubaki, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 118 days.

(21) Appl. No.: 14/249,374

(22) Filed: Apr. 10, 2014

(65) Prior Publication Data

US 2014/0218262 A1 Aug. 7, 2014

Related U.S. Application Data

(63) Continuation of application No. PCT/JP2012/076024, filed on Oct. 5, 2012.

(30) Foreign Application Priority Data

Nov. 14, 2011 (JP) ..... 2011-248754

(51) Int. Cl.

| | |
|---|---|
| ***H01Q 1/36*** | (2006.01) |
| ***H01Q 7/00*** | (2006.01) |
| ***H01Q 1/38*** | (2006.01) |
| ***H01Q 21/29*** | (2006.01) |

(52) U.S. Cl.

CPC ..... *H01Q 7/00* (2013.01); *H01Q 1/38* (2013.01); *H01Q 21/29* (2013.01)

(58) Field of Classification Search

USPC ..... 343/867, 702, 895

See application file for complete search history.

(56) References Cited

U.S. PATENT DOCUMENTS

| | | | | |
|---|---|---|---|---|
| 5,424,527 | A | 6/1995 | Takahira | |
| 7,355,559 | B2 * | 4/2008 | Tikhov | H01Q 1/38 343/700 MS |
| 2007/0051807 | A1 | 3/2007 | Yamaguchi | |

(Continued)

FOREIGN PATENT DOCUMENTS

| | | | |
|---|---|---|---|
| JP | 06-069044 | A | 3/1994 |
| JP | 11-213108 | A | 8/1999 |
| JP | 2002-175508 | A | 6/2002 |

(Continued)

OTHER PUBLICATIONS

Official Communication issued in International Patent Application No. PCT/JP2012/076024, mailed on Dec. 25, 2012.

(Continued)

*Primary Examiner* — Hoang Nguyen
*Assistant Examiner* — Hai Tran
(74) *Attorney, Agent, or Firm* — Keating & Bennett, LLP

(57) ABSTRACT

In order to increase flexibility regarding a disposition of an antenna coil and to enable a hot spot to be provided at a desired position, an antenna device includes a main coil antenna and a sub-coil antenna connected to the main coil antenna. A coil opening of the sub-coil antenna and a coil opening of the main coil antenna are arranged side by side in plan view so that the main coil antenna and the sub-coil antenna are magnetically coupled to each other. The main coil antenna and the sub-coil antenna are wound so as to generate magnetic fields having opposite phases.

19 Claims, 13 Drawing Sheets

(56) References Cited

U.S. PATENT DOCUMENTS

| | | | | |
|---|---|---|---|---|
| 2007/0126857 | A1* | 6/2007 | Turtinen | H04N 5/775<br>348/14.01 |
| 2009/0033580 | A1* | 2/2009 | Hozouri | G06K 19/07749<br>343/803 |

FOREIGN PATENT DOCUMENTS

| | | | |
|---|---|---|---|
| JP | 2004-056413 | A | 2/2004 |
| JP | 2005-352858 | A | 12/2005 |
| JP | 2006-048580 | A | 2/2006 |
| JP | 2008-310453 | A | 12/2008 |
| JP | 2010-198547 | A | 9/2010 |
| JP | 2010-226574 | A | 10/2010 |
| WO | 2005/017821 | A1 | 2/2005 |

OTHER PUBLICATIONS

Official Communication issued in corresponding Japanese Patent Application No. 2013-544184, mailed on Dec. 24, 2014.

* cited by examiner

ANTENNA DEVICE AND WIRELESS COMMUNICATION APPARATUS

BACKGROUND OF THE INVENTION

1. Field of the Invention

The present invention relates to an antenna device preferably for use in short-range wireless communication and a wireless communication apparatus including the antenna device.

2. Description of the Related Art

NFC (near field communication), which uses a 13 MHz frequency band, is a short-range wireless communication standard. NFC is expected to be used for electronic apparatuses, such as cell phones. If NFC were widely used, wireless communication between electronic apparatuses could be performed by simply bringing the electronic apparatuses close to each other. As a result, data transfer and data communication could be easily performed. Therefore, various applications of NFC, such as contactless cashless payment, are being developed. In the present specification, electronic apparatuses that are capable of performing short-range wireless communication will be referred to as wireless communication apparatuses.

Japanese Unexamined Patent Application Publication No. 2004-56413 describes an existing wireless communication apparatus of this type. Japanese Unexamined Patent Application Publication No. 2004-56413 describes a portable apparatus having an IC card function, which is a wireless communication apparatus. The portable apparatus includes a portable apparatus module that is removably mounted therein. The portable apparatus module includes an integrated control circuit, a memory, and an antenna coil. The portable apparatus further includes a second antenna coil that is electromagnetically coupled to a first antenna coil, which is included in the portable apparatus module. The portable apparatus performs contactless communication with an external reader/writer through the second antenna coil.

Japanese Unexamined Patent Application Publication No. 2002-175508 describes another wireless communication apparatus. Japanese Unexamined Patent Application Publication No. 2002-175508 describes a contactless data carrier apparatus, which is a wireless communication apparatus. The data carrier apparatus includes an antenna coil disposed on a semiconductor chip and a booster coil disposed adjacent to the antenna coil. The booster coil is larger than the antenna coil. By using such a booster antenna for wireless communication, the peak of resonance of a signal received from an external reader/writer can be made higher. Therefore, the communication range can be extended as compared with a case where the antenna coil on the semiconductor chip is used.

In recent years, reduction in size and increase in packing density of electronic apparatuses have been rapidly progressing. Therefore, it is difficult to find enough space in which to install an antenna coil when mounting a communication module or the like compliant with an NFC standard in a casing of an electronic apparatus. As a result, the antenna coil is disposed too close to surrounding components in the electronic apparatus, and unwanted coupling between the antenna coil and surrounding components may occur. Such unwanted coupling causes a problem of a decrease in the performance of the antenna coil.

To perform short-range wireless communication, hot spots of wireless communication apparatuses are brought close to each other. The term "hot spot" refers to a portion of a surface of a casing of a wireless communication apparatus at which the magnetic field of an antenna coil is strong. To date, wireless communication apparatuses have been designed so that the hot spot is located above the antenna coil. However, as described above, it has become difficult to provide enough space in which to install the antenna coil. Therefore, there is a problem in that it is difficult to form a hot spot at a desired position.

SUMMARY OF THE INVENTION

Preferred embodiments of the present invention provide an antenna device with which flexibility regarding a location of an antenna coil is increased and a hot spot is easily and reliably provided at a desired position, and provide a wireless communication apparatus including the antenna device.

According to an aspect of a preferred embodiment of the present invention, an antenna device includes a main coil antenna, and a sub-coil antenna connected to the main coil antenna. A coil opening of the sub-coil antenna and a coil opening of the main coil antenna are arranged side by side in plan view so that the main coil antenna and the sub-coil antenna are magnetically coupled to each other. The main coil antenna and the sub-coil antenna are wound so as to generate magnetic fields having opposite phases.

According to another aspect of a preferred embodiment of the present invention, a wireless communication apparatus includes such an antenna device.

With the antenna device and the wireless communication apparatus including the antenna device according to various preferred embodiments of the present invention, a closed magnetic circuit is provided between the main coil antenna and the sub-coil antenna. Accordingly, the position of a hot spot of the antenna device is moved to a position above the midpoint between these coil antennas, and it is possible to provide the antenna device with directivity at the midpoint. In this way, the position of the hot spot is adjusted by using the sub-coil antenna. Therefore, it is possible to provide an antenna device with which flexibility regarding the location of the main antenna coil is increased and a hot spot is easily and reliably provided at a desired position.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
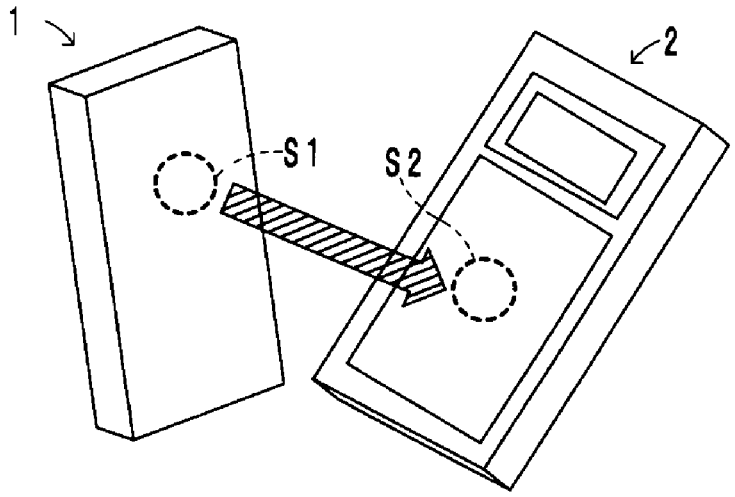
FIG. 1 is schematic view of a wireless communication system including a wireless communication apparatus according to a preferred embodiment of the present invention.

In FIG. 1, a wireless communication system includes a wireless communication apparatus 1 and a reader/writer 2. For example, the wireless communication apparatus 1 preferably has the function of a cellular phone. Moreover, the wireless communication apparatus 1 is capable of performing wireless communication with the reader/writer 2 in accordance with a short-range wireless communication standard, such as NFC. Before starting the wireless communication, a user first brings a hot spot S1 of the wireless communication apparatus 1 close to a hot spot S2 of the reader/writer 2. The hot spots S1 and S2 are respectively positions at which the magnetic fields of built-in coil antennas (described below) of the wireless communication apparatus 1 and the reader/writer 2 are strong.

First Preferred Embodiment

Figure 2A:
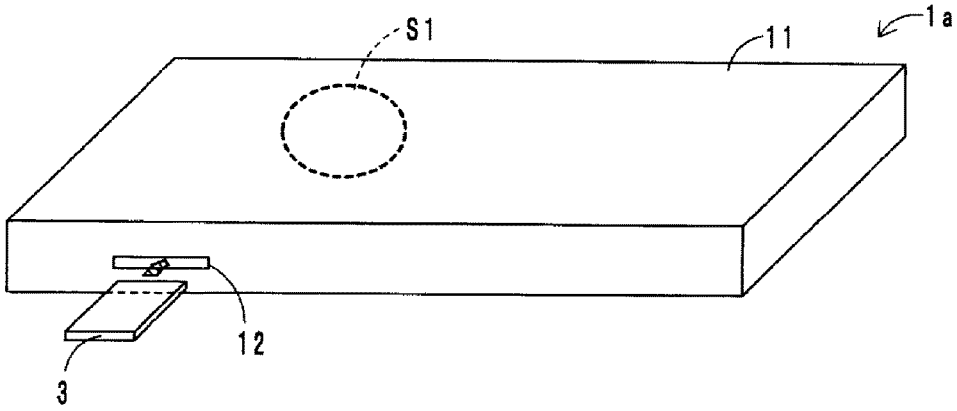
FIG. 2A is an external perspective view schematically illustrating a wireless communication apparatus (an antenna device) according to a first preferred embodiment of the present invention.
Figure 2B:
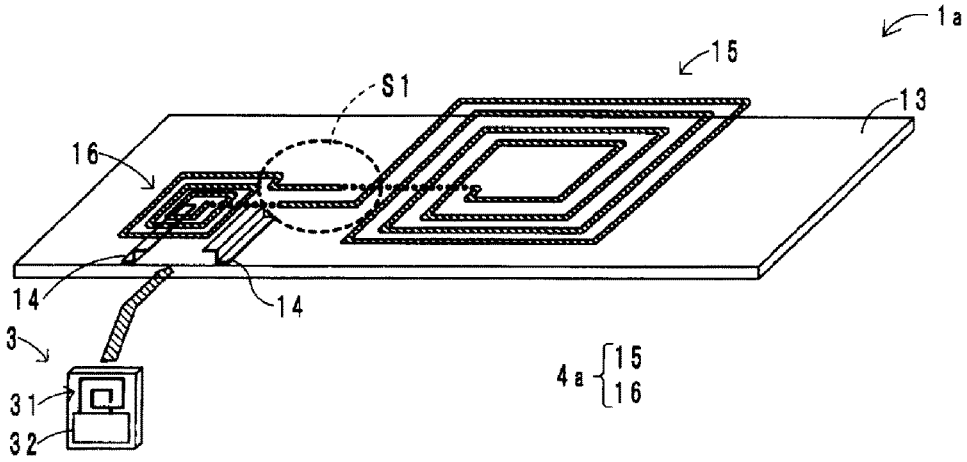
FIG. 2B is a perspective view schematically illustrating the internal structure of the apparatus.

Hereinafter, a wireless communication apparatus 1*a* according to a first preferred embodiment of the present invention will be described. In FIGS. 2A and 2B, the wireless communication apparatus 1*a* generally includes a casing 11, a card insertion slot 12, a printed circuit board 13, a pair of guides 14, and an antenna device 4*a*. The antenna device 4*a* includes a main coil antenna 15 and a sub-coil antenna 16.

The card insertion slot 12 is preferably provided, for example, in a side surface of the casing 11. A storage media 3, such as a microSD (trademark) card, is inserted into the card insertion slot 12. As shown in FIG. 2B, the storage media 3 includes a feeding circuit connected to a feeding coil 31. The feeding circuit includes an IC chip 32, and the IC chip 32 is configured and programmed to control data communication with the reader/writer 2 in accordance with an NFC application installed therein.

The printed circuit board 13 is disposed in the casing 11. For example, electronic components and the like that perform a cell phone function are mounted on the printed circuit board 13 with a high density. Such electronic components are not shown in the drawings, because they are not essential for the present preferred embodiment.

The pair of guides 14 are disposed on the printed circuit board 13. When inserted into the card insertion slot 12, the storage media 3 is guided into the casing 11 as both sides of the storage media 3 slide along the guides 14. Then, the storage media 3 is fixed in place.

The main coil antenna 15 of the antenna device 4*a* preferably is a rectangular or substantially rectangular planar coil, which is disposed in the casing 11. The main coil antenna 15 functions as a booster coil to extend the communication range. The outer size of the main coil antenna 15 preferably is, for example, approximately 5 cm×5 cm.

Preferably, the hot spot S1 is located, for example, at a position that is convenient for a user (a position that allows the user to easily bring the hot spot S1 close to the hot spot S2). In existing technologies, the position of the hot spot S1 was closely related to the position of the main coil antenna 15. To be specific, the hot spot S1 was disposed directly above the main coil antenna 15. However, as reduction in size and increase in packing density of the wireless communication apparatus 1*a* have progressed in recent years, it has become difficult to freely locate the main coil antenna 15 in the casing 11. As a result, it has become difficult to locate the hot spot S1 at a position that is convenient for a user and that is directly above the main coil antenna 15. Therefore, the present preferred embodiment includes the sub-coil antenna 16 to adjust the position of the hot spot S1.

The sub-coil antenna 16 preferably is a rectangular or substantially rectangular planar coil. In the present preferred embodiment, the sub-coil antenna 16 not only adjusts the position of the hot spot S1 but also becomes magnetically coupled to the feeding coil 31. The outer size of the sub-coil antenna 16 is smaller than that of the main coil antenna 15. The outer size preferably is, for example, approximately 1.5 cm×1.5 cm.

The sub-coil antenna 16 is disposed so that its coil opening and a coil opening of the main coil antenna 15 are arranged side by side in plan view. The sub-coil antenna 16 is disposed at a position at which the sub-coil antenna 16 is magnetically coupled to the main coil antenna 15. The sub-coil antenna 16 is wound so as to generate a magnetic field having a phase opposite to that of a magnetic field generated by the main coil antenna 15. The sub-coil antenna 16 is disposed in the casing 11 so that the sub-coil antenna 16 is positioned directly above the feeding coil 31 inserted into the casing 11.

Figure 3:
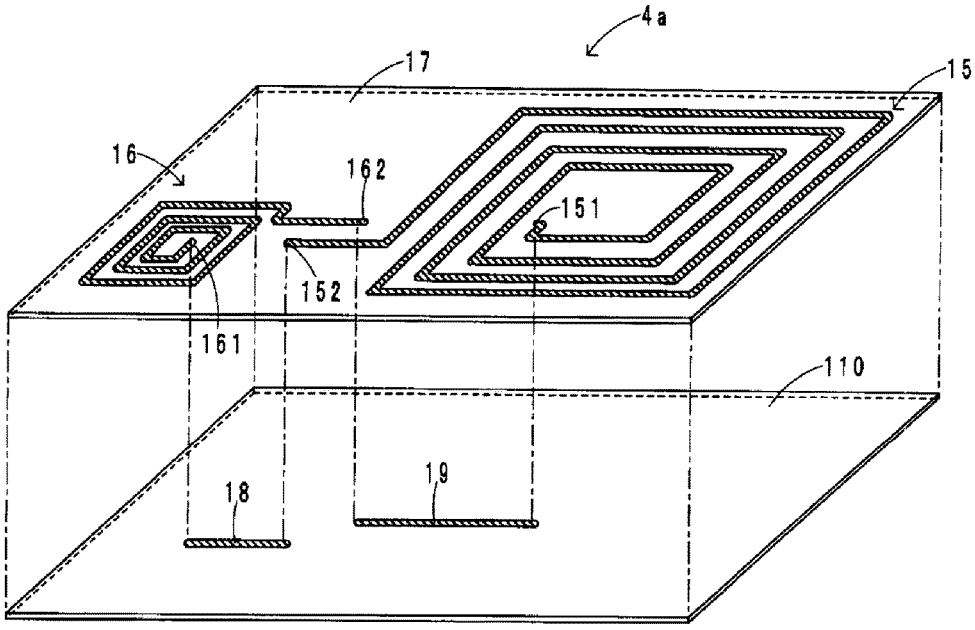
FIG. 3 is a schematic view illustrating the detailed structures of two coil antennas of FIGS. 2A and 2B.
Figure 4A:
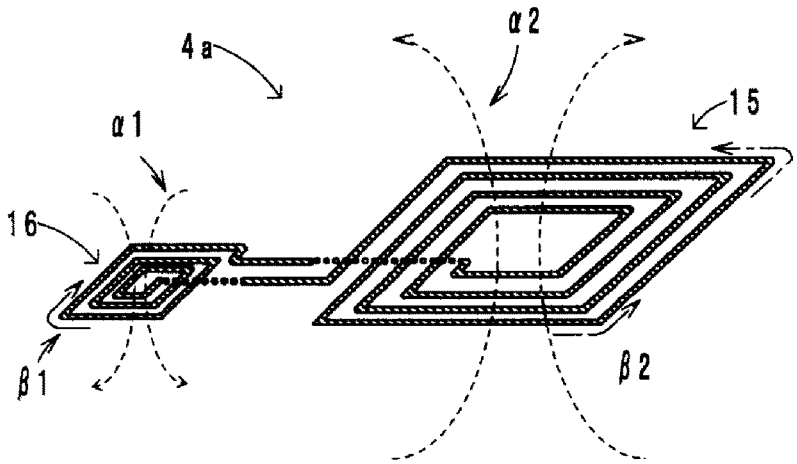
FIG. 4A is a perspective view schematically illustrating magnetic fields generated by the two coil antennas of FIGS. 2A and 2B.
Figure 4B:
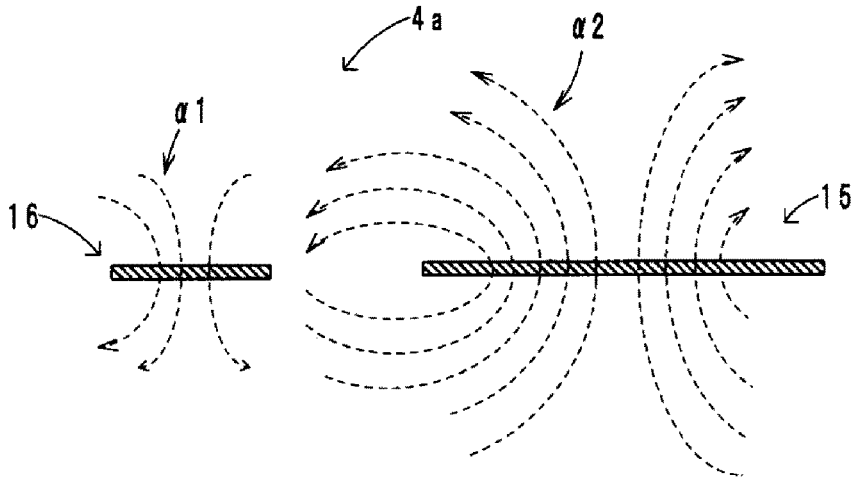
FIG. 4B is a cross-sectional view schematically illustrating the magnetic fields.

Examples of the detailed structures of the coil antennas 15 and 16 will be described below. In FIG. 3, the coil antennas 15 and 16 are provided on a main surface of a first substrate 17. In the present preferred embodiment, for example, the main coil antenna 15 has a spiral shape extending clockwise from an outer terminal electrode 152 toward an inner terminal electrode 151. For example, the sub-coil antenna 16 has a spiral shape extending counterclockwise from an outer terminal electrode 162 toward an inner terminal electrode 161. The sub-coil antenna 16 is disposed on a side of the main coil antenna 15. Below the electrodes 151, 152, 161, and 162, through-holes are configured to connect the coil antennas 15 and 16 to connection conductors 18 and 19.

A first connection conductor 18 configured to connect the terminal electrodes 152 and 161 to each other and a second connection conductor 19 configured to connect the terminal electrodes 151 and 162 to each other are provided on a main surface of a second substrate 110. The first substrate 17 is stacked on the main surface of the second substrate 110. The coil antennas 15 and 16 and the connection conductors 18 and 19 are preferably formed on the substrate by, for example, etching a copper foil. The substrates 17 and 110 are preferably made from, for example, flexible insulating substrates.

Next, the operational effects of the coil antennas 15 and 16 will be described with reference to FIGS. 4A and 4B and FIGS. 5A and 5B. When the feeding coil 31 (not shown in FIG. 4A) generates a magnetic field, the magnetic field extends through the sub-coil antenna 16 as represented by a dotted-line-arrow $\alpha 1$. Accordingly, an induced current flows through the sub-coil antenna 16 as indicated by an arrow $\beta 1$. The induced current flows through the main coil antenna 15 as indicated by an arrow $\beta 2$ and generates a magnetic field extending through the main coil antenna 15 (see an arrow $\alpha 2$). Because the directions of current loops of the coil antennas 15 and 16 are opposite to each other, the directions of magnetic fields extending through the coil antennas 15 and 16 are opposite to each other. Thus, a closed magnetic circuit is provided between the main coil antenna 15 and the sub-coil antenna 16.

Figure 5A:
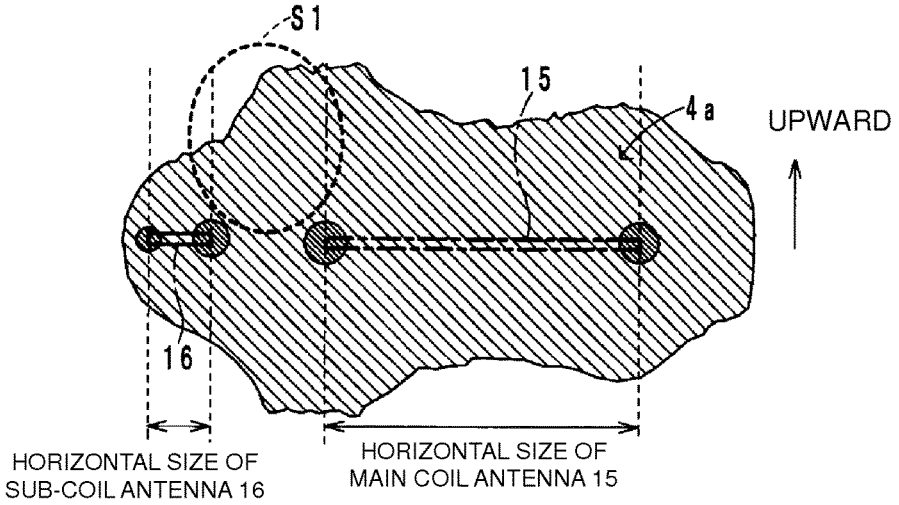
FIG. 5A illustrates a hot spot of the wireless communication apparatus (the antenna device) of FIGS. 2A and 2B.

FIG. 5A illustrates the result of simulation performed to analyze electromagnetic field distribution of the antenna device 4*a* by using hatching. In FIG. 5A, regions around the coil antennas 15 and 16, where the magnetic field is particularly strong, are represented by dense hatching. Regions where the magnetic field is strong are represented by sparse hatching. The magnetic field is distributed not only over the main coil antenna 15 but also over a region above the midpoint between the coil antennas 15 and 16 as shown by a dotted-line-ellipse in FIG. 5A. Thus, by providing the sub-coil antenna 16, the hot spot S1 is moved to a region above the midpoint between the coil antennas 15 and 16. In other words, it is possible to provide the antenna device 4*a* with directivity toward the midpoint between the coil antennas 15 and 16. In other words, the position of the hot spot S1 is not limited to a position directly or substantially directly above the main coil antenna 15, and the position is appropriately adjusted by using the sub-coil antenna 16. As a result, because the location of the main antenna coil 15 is not restricted by the position of the hot spot S1, it is possible to increase flexibility regarding the location of the main antenna coil 15 and to provide the antenna device 4*a* with which the hot spot S1 is easily and reliably provided at a desired position. Moreover, for example, it is possible to expand the hot spot S1 by appropriately adjusting the distance between the main antenna coil 15 and the sub-coil antenna 16 or the like.

Figure 5B:
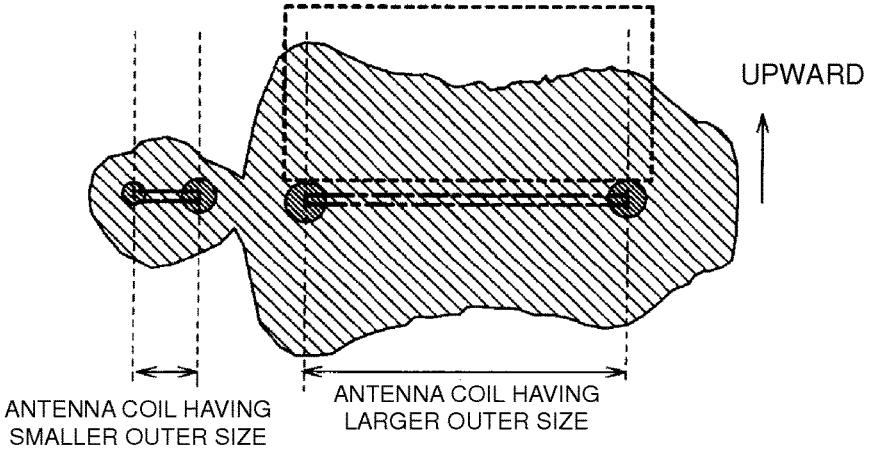
FIG. 5B illustrates directivity obtained when the two coil antennas are simply arranged side by side.

If the two coil antennas generated magnetic fields in the same direction, the magnetic fields would repulse each other and a closed magnetic circuit would not be generated between the two antenna coils. Therefore, as shown in FIG. 5B, the directivity of the antenna device, that is, the hot spot, would be substantially limited to a region that is directly above a coil having a larger outer shape (see the dotted-line rectangle in FIG. 5B).

Figure 6:
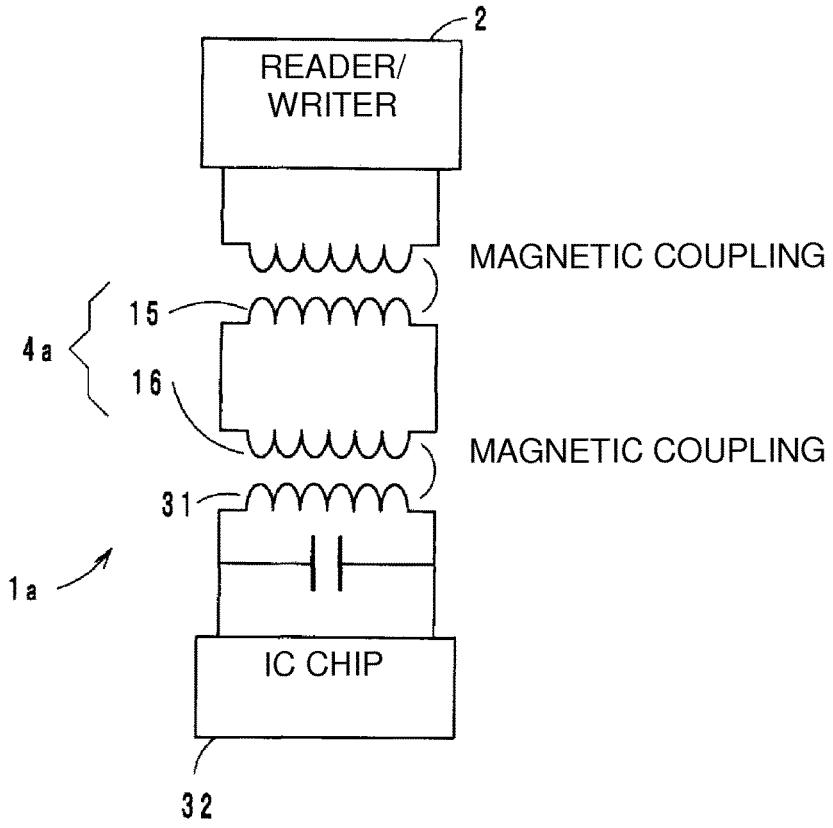
FIG. 6 is a schematic view illustrating magnetic coupling that occurs in a wireless communication apparatus and magnetic coupling that occurs between the wireless communication apparatus and a reader/writer.

Hereinafter, as an example of an operation of the wireless communication apparatus 1*a*, an operation of reading data in the IC chip 32 in a case where the wireless communication apparatus 1*a* serves as a passive tag will be described. As shown in FIG. 6, the sub-coil antenna 16 is magnetically coupled to the feeding coil 31. When a user brings the hot spot of the wireless communication apparatuses 1*a* close to the hot spot of the reader/writer 2, the main coil antenna 15 becomes magnetically coupled to a coil antenna of the reader/writer 2. In this state, a signal in which a plurality of sub-carriers are modulated using a read command is sent from the reader/writer 2.

In the wireless communication apparatus 1*a*, the feeding circuit transmits a signal to and receives a signal from the reader/writer 2 through the main coil antenna 15, the sub-coil antenna 16, and the feeding coil 31, that is, via the magnetic fields. From this viewpoint, the feeding circuit is connected to the main coil antenna 15 via a magnetic field. Accordingly, the feeding circuit receives a modulation signal sent from the reader/writer 2 through the coils. The feeding circuit generates direct current power by rectifying and smoothing the received signal by using a switching diode and the like, which are disposed in the feeding circuit. The IC chip 32 is driven by the generated direct current power. The IC chip 32 reads data by reproducing the read command from the received signal and then generates a reflection signal by modulating unmodulated sub-carriers using the read data. The reflection signal is sent from the feeding coil 31 to the reader/writer 2 through the coils.

Figure 7:
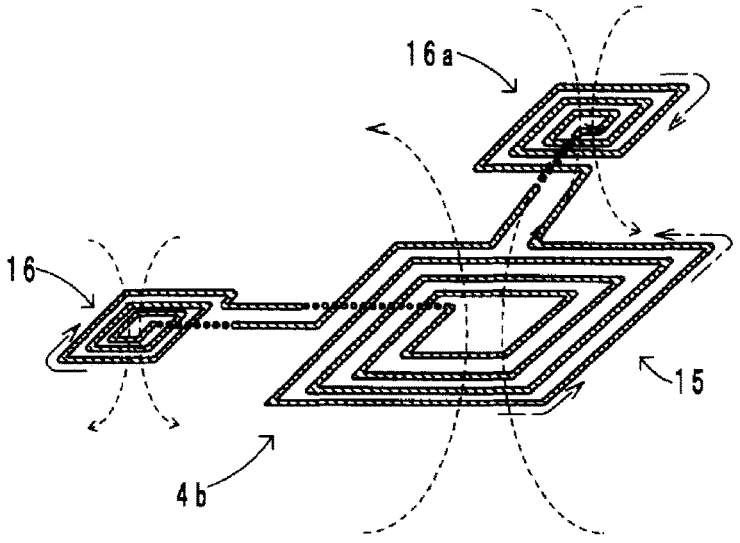
FIG. 7 is a schematic view illustrating an antenna device according to a first modification of a preferred embodiment of the present invention.

Next, referring to FIG. 7, an antenna device according to a first modification of a preferred embodiment of the present invention will be described. In FIG. 7, an antenna device 4*b* differs from the antenna device 4*a* in that it further includes a second sub-coil antenna 16*a*. In other respects, there is no difference between the antenna devices 4*a* and 4*b*. Therefore, components of the antenna device 4*b* corresponding to those of the antenna device 4*a* will be denoted by the same reference numerals, and descriptions thereof will be omitted.

The sub-coil antenna 16 described above is connected to a side of the main coil antenna 15, which preferably has a rectangular or substantially rectangular shape. The second sub-coil antenna 16*a* is connected to a side adjacent to this side. The second sub-coil antenna 16*a* is disposed so that its coil opening and a coil opening of the main coil antenna 15 are arranged side by side and so that the second sub-coil antenna 16*a* is magnetically coupled to the main coil antenna 15. The second sub-coil antenna 16*a* is wound in the same direction as the sub-coil antenna 16. By providing the second sub-coil antenna 16*a*, a closed magnetic circuit is provided also between the main coil antenna 15 and the second sub-coil antenna 16*a*. Therefore, the position of the hot spot S1 is moved from a position directly above the main coil antenna to a region between the main coil antenna 15 and the sub-coil antenna 16 and between the main coil antenna 15 and the second sub-coil antenna 16*a*.

Figure 8A:
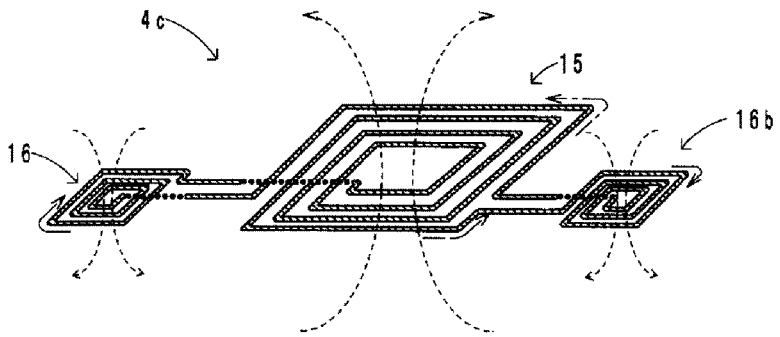
FIG. 8A is a schematic view illustrating an antenna device according to a second modification of a preferred embodiment of the present invention.
Figure 8B:
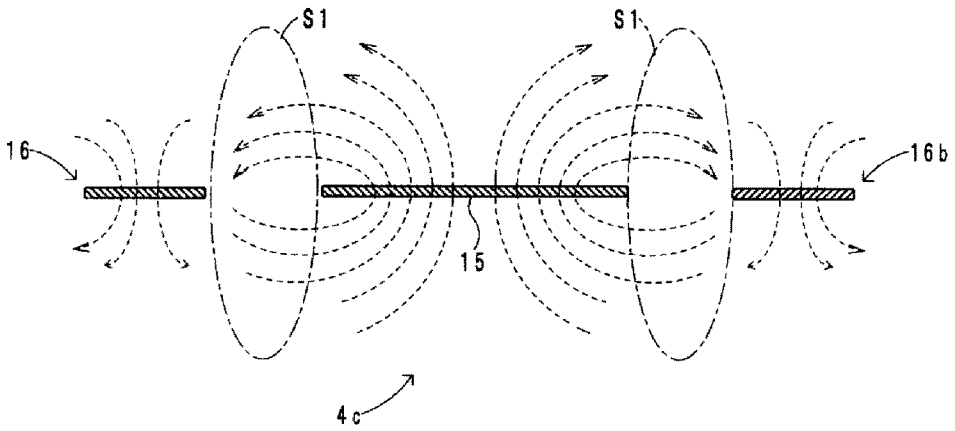
FIG. 8B is a cross-sectional view schematically illustrating magnetic fields generated in the device.

Next, referring to FIGS. 8A and 8B, an antenna device according to a second modification of a preferred embodiment of the present invention will be described. In FIG. 8A, an antenna device 4*c* differs from the antenna device 4*a* in that it further includes a second sub-coil antenna 16*b*. In other respects, there is no difference between the antenna devices 4*a* and 4*c*. Therefore, components of the antenna device 4*c* corresponding to those of the antenna device 4*a* will be denoted by the same reference numerals, and descriptions thereof will be omitted.

The second sub-coil antenna 16*b* is connected to a side opposite the sub-coil antenna 16. In other respects, the second sub-coil antenna 16*b* is preferably the same as the second sub-coil antenna 16*a* described above, and descriptions thereof will be omitted. By providing the second sub-coil antenna 16*b*, it is possible to move the hot spot S1 in directions toward the two sub-coil antennas 16 and 16*b* with respect to the main coil antenna 15 as shown in FIG. 8B and to provide the antenna device 4*c* with directivity in these directions.

It would be possible to move the hot spot S1 in two directions by increasing the size of the main coil antenna 15. However, as described above, it is difficult to provide enough space in the casing 11 in which to install the coil antenna because of reduction in size and increase in packing density of the wireless communication apparatus 1*a*. Under such circumstances, it is very effective to move the hot spot S1 by providing the sub-coil antennas 16 and 16*b*, which are relatively smaller, in addition to the main coil antenna 15 as in the second modification.

Second Preferred Embodiment

Figure 9A:
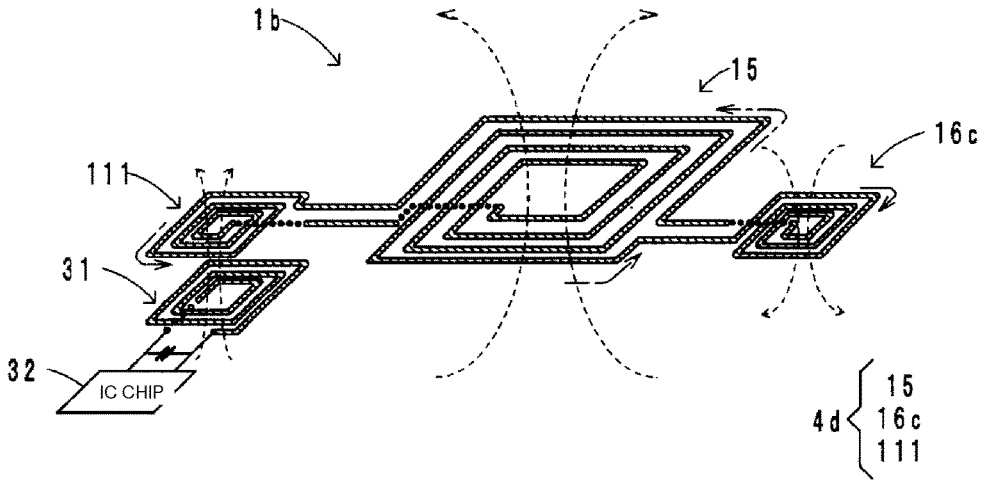
FIG. 9A is a perspective view illustrating a wireless communication apparatus (an antenna device) according to a second preferred embodiment of the present invention.
Figure 9B:
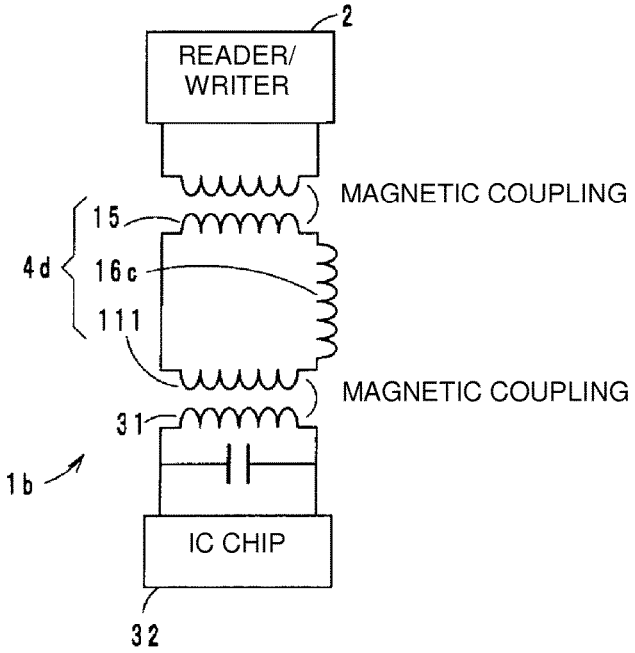
FIG. 9B is a schematic view illustrating magnetic coupling that occurs in the apparatus and magnetic coupling that occurs between the apparatus and a reader/writer.

Next, referring to FIGS. 9A and 9B, a wireless communication apparatus according to a second preferred embodiment of the present invention will be described. In FIGS. 9A and 9B, a wireless communication apparatus 1*b* (an antenna device 4*d*) differs from the wireless communication apparatus 1*a* (the antenna device 4*a*) in that it includes a sub-coil antenna 16*c* and a coupling coil 111 instead of the sub-coil antenna 16. In other respects, there is preferably no difference between the wireless communication apparatuses 1*a* and 1*b*. Therefore, components of the wireless communication apparatus 1*b* corresponding to those of the wireless communication apparatus 1*a* will be denoted by the same reference numerals, and descriptions thereof will be omitted.

The sub-coil antenna 16*c* differs from the sub-coil antenna 16 in that it does not become magnetically coupled to the feeding coil 31. In other respects, they are the same, and description thereof will be omitted.

The coupling coil 111 preferably is a rectangular or substantially rectangular planar coil whose outer size is smaller than that of the main coil antenna 15 and is connected to a side of the main coil antenna 15 opposite the sub-coil antenna 16*c*. The coupling coil 111 is disposed directly above the feeding coil 31 and becomes magnetically coupled to the feeding coil 31. The coupling coil 111 is disposed so that its coil opening and the coil opening of the main coil antenna 15 are arranged side by side. The coupling coil 111 is wound so as to generate a magnetic field having a phase the same as that of a magnetic field generated by the main coil antenna 15. Also with the wireless communication apparatus 1*b* (the antenna device 4*d*) having such a structure, the hot spot S1 is moved to a position between the main coil antenna 15 and the sub-coil antenna 16*c*. Therefore, the second preferred embodiment provides a technical advantage the same as that of the first preferred embodiment.

Third Preferred Embodiment

Figure 10A:
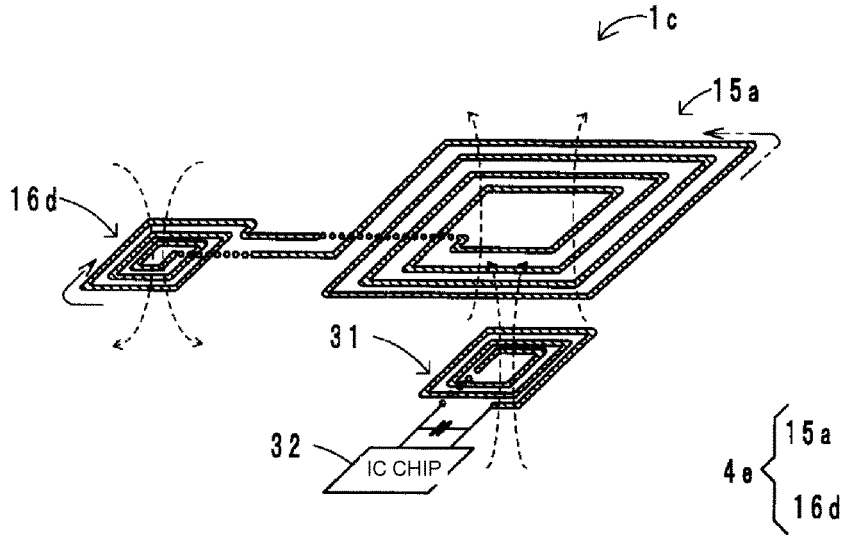
FIG. 10A is a perspective view illustrating a wireless communication apparatus (an antenna device) according to a third preferred embodiment of the present invention.
Figure 10B:
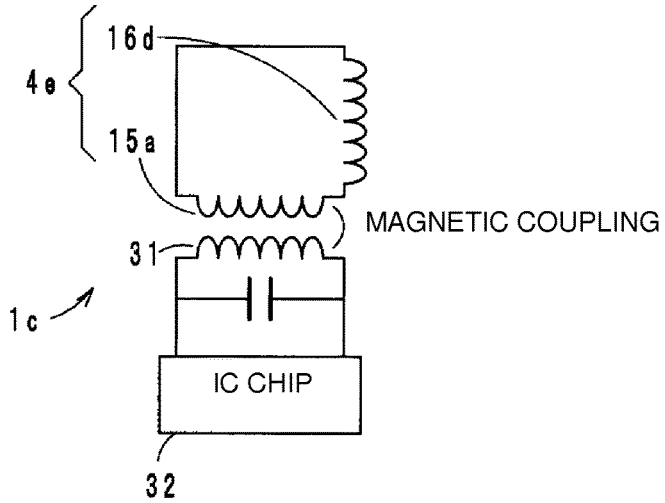
FIG. 10B is a schematic view illustrating magnetic coupling that occurs in the apparatus.

Next, referring to FIGS. 10A and 10B, a wireless communication apparatus 1*c* according to a third preferred embodiment of the present invention will be described. In FIGS. 10A and 10B, the wireless communication apparatus 1*c* (an antenna device 4*e*) differs from the wireless communication apparatus 1*a* (the antenna device 4*a*) in that it includes a sub-coil antenna 16*d* instead of the sub-coil antenna 16 and in that it includes a main coil antenna 15*a* instead of the main coil antenna 15. In other respects, there is preferably no difference between the wireless communication apparatuses 1*a* and 1*c*. Therefore, components of the wireless communication apparatus 1*c* corresponding to those of the wireless communication apparatus 1*a* will be denoted by the same reference numerals, and descriptions thereof will be omitted.

The sub-coil antenna 16*d* differs from the sub-coil antenna 16 in that it does not become magnetically coupled to the feeding coil 31. In other respects, the sub-coil antenna 16*d* is preferably the same as the sub-coil antenna 16, and descriptions thereof will be omitted. The main coil antenna 15*a* differs from the main coil antenna 15 in that, for example, it is disposed directly above the feeding coil 31 of the storage media 3 and becomes magnetically coupled to the feeding coil 31. In other respects, the main coil antenna 15*a* is preferably the same as the main coil antenna 15, and descriptions thereof will be omitted. With the wireless communication apparatus 1*c* (the antenna device 4*e*), the position of the hot spot S1 is moved toward the sub-coil antenna 16*d*. Therefore, the third preferred embodiment provides an advantage the same as that of the first preferred embodiment.

Figure 11:
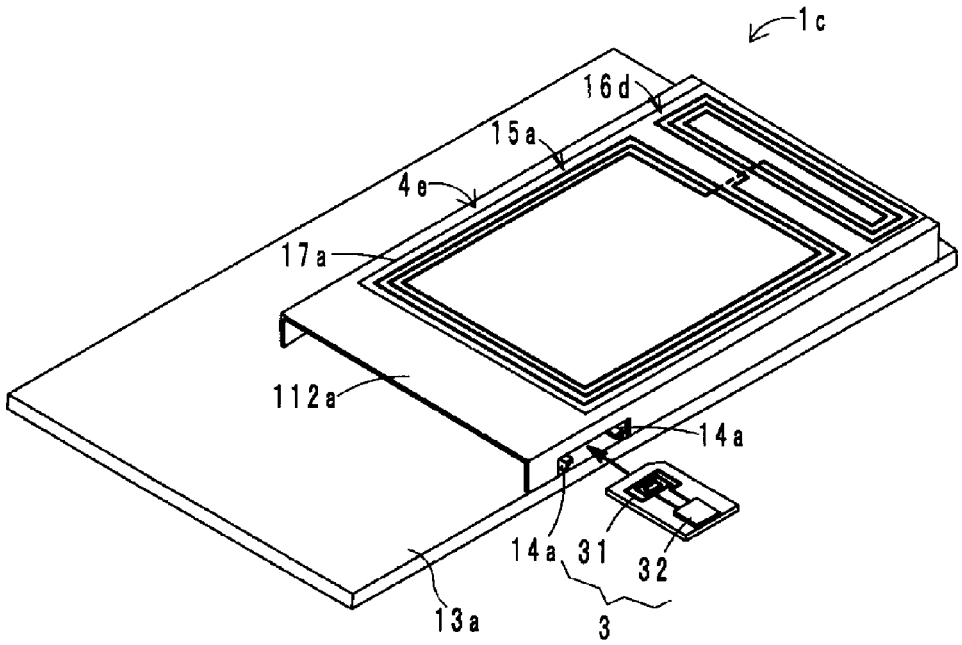
FIG. 11 is a schematic view illustrating an example of a specific location of the antenna device of FIGS. 10A and 10B.

Referring to FIG. 11, a specific example of disposition of the antenna device 4*e* will be described. In FIG. 11, a pair of guides 14*a* are mounted on a printed circuit board 13*a* of the wireless communication apparatus 1*c*. A case 112*a* is disposed on the printed circuit board 13*a* so as to cover the guides 14*a*. The case 112*a* has an opening into which the storage media 3 is inserted. In the antenna device 4*e*, the coil antennas 15*a* and 16*d* are provided on an insulating substrate 17*a* having flexibility. A method of forming the coil antennas 15*a* and 16*d* on the insulating substrate 17*a* will not be described here, because it is preferably the same as that described above with reference to FIG. 3. The antenna device 4*e* is affixed to the case 112*a* so that the main coil antenna 15 can be magnetically coupled to the feeding coil 31. Preferably, the case 112*a* is made of a nonmetallic material. This is to prevent generation of eddy current due to the magnetic fields of the coil antennas 15*a* and 16*d*. However, this is not a limitation, and the case 112*a* may be made of a metallic material. In this case, a magnetic sheet having a relatively high magnetic permeability is interposed between the antenna device 4*e* and the case 112*a*, which is metallic.

Figure 12:
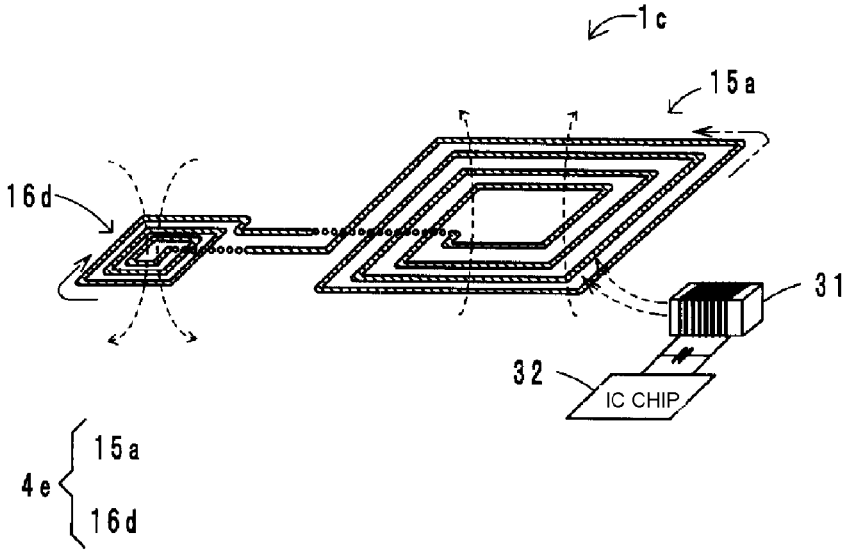
FIG. 12 is a schematic view illustrating an example of a substitute for a feeding coil of FIGS. 10A and 10B.

In FIG. 10A, the feeding coil 31 is disposed so that its winding axis is parallel or substantially parallel to the winding axis of the main coil antenna 15*a*. However, this is not a limitation, and it is sufficient that the feeding coil 31 and the main antenna can be magnetically coupled to each other. Therefore, as illustrated in FIG. 12, the feeding coil 31 may be disposed so that its winding axis is not parallel to the winding axis of the main coil antenna 15*a*. In this case, preferably, the winding axis of the feeding coil is parallel or substantially parallel to the in-plane direction of the circuit board, including a conductor plate, and the in-plane direction of a battery pack. With such a configuration, a magnetic field generated by the feeding coil 31 is not blocked by the conductor plate even if a magnetic body configured to guide the magnetic field is not used, and the feeding coil 31 and the main coil antenna 15*a* preferably are magnetically coupled to each other.

Fourth Preferred Embodiment

Figure 13A:
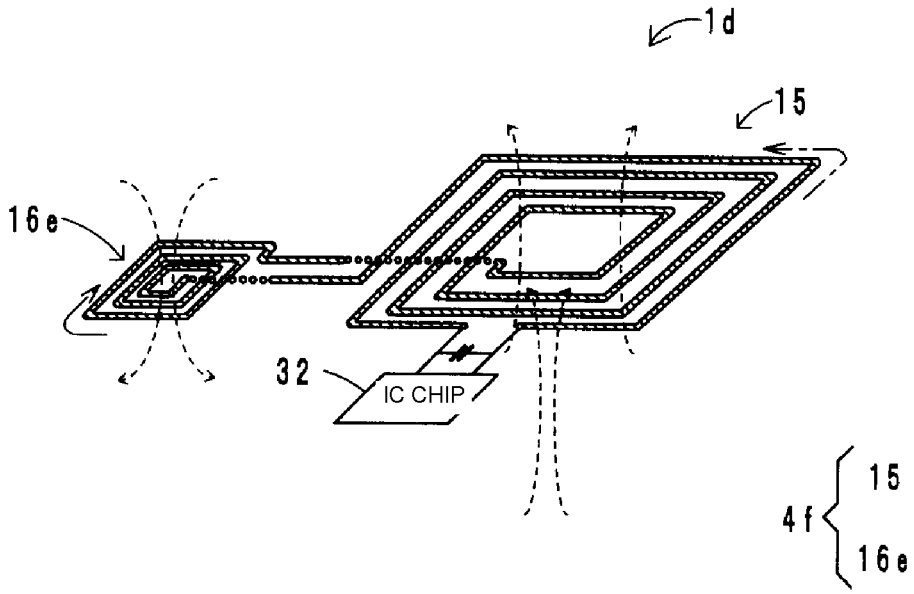
FIG. 13A is a perspective view illustrating a wireless communication apparatus (an antenna device) according to a fourth preferred embodiment of the present invention.
Figure 13B:
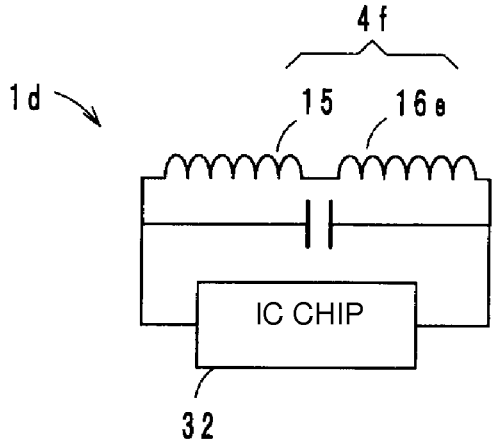
FIG. 13B is a schematic view illustrating magnetic coupling that occurs in the apparatus.

Next, referring to FIGS. 13A and 13B, a wireless communication apparatus 1*d* according to a fourth preferred embodiment of the present invention will be described. The wireless communication apparatus 1*d* (an antenna device 4*f*) differs from the wireless communication apparatus 1*a* (the antenna device 4*a*) in the following respects. First, a feeding coil is not connected to a feeding circuit, including the IC chip 32, but is directly connected to the main coil antenna 15. Therefore, the main coil antenna 15 generates a magnetic field by using alternate current power supplied from the feeding circuit. Second, the antenna device 4*f* includes a sub-coil antenna 16*e* instead of the sub-coil antenna 16. The sub-coil antenna 16*e* differs from the sub-coil antenna 16*a* in that it has only the function of adjusting the position of the hot spot S1. In other respects, preferably there is no difference between the wireless communication apparatuses 1*a* and 1*d*. Therefore, the components of the wireless communication apparatus 1*d* the same as those of the wireless communication apparatus 1*a* will be denoted by the same reference numerals, and descriptions thereof will be omitted. Also with the wireless communication apparatus 1*d*, the position of the hot spot S1 is moved toward the sub-coil antenna 16*e*. Therefore, the fourth preferred embodiment provides a technical advantage the same as that of the first preferred embodiment.

Figure 14:
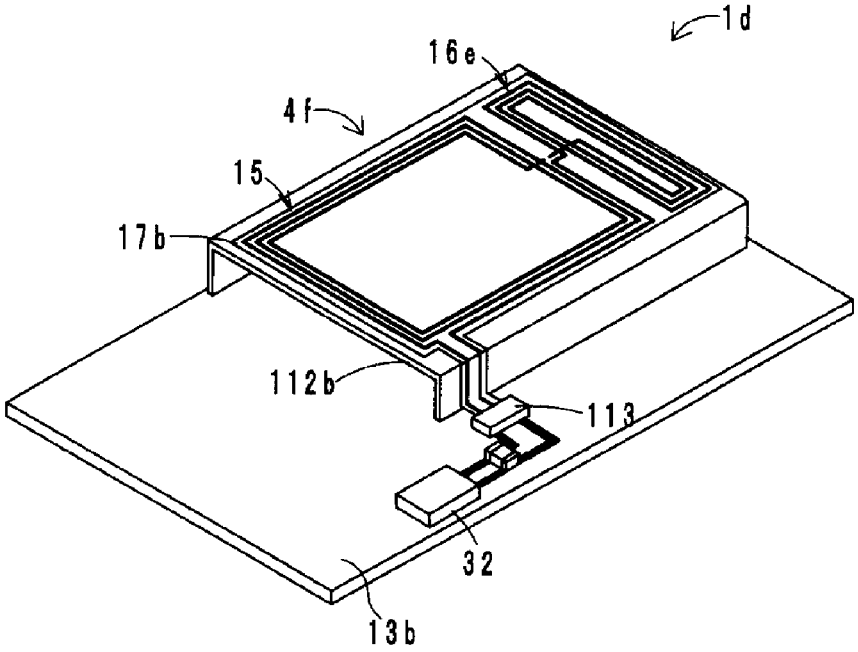
FIG. 14 is a schematic view illustrating an example of a specific location of the antenna device of FIGS. 13A and 13B.

Referring to FIG. 14, a specific example of disposition of the antenna device 4*f* will be described. In FIG. 14, a feeding circuit, including the IC chip 32, is mounted on a printed circuit board 13*b* of the wireless communication apparatus 1*d*. A case 112*b* is disposed on the printed circuit board 13*b* at a position separated from the IC chip 32. As in the antenna device 4*e*, the coil antennas 15 and 16*e* of the antenna device 4*f* are provided on a flexible insulating substrate 17*b*. The antenna device 4*f* is affixed to the case 112*b*. The main coil antenna 15 is connected to the feeding circuit, including the IC chip 32, through an FPC connector 113. As with the case 112*a*, the case 112*b* may be metallic or nonmetallic.

Figure 15:
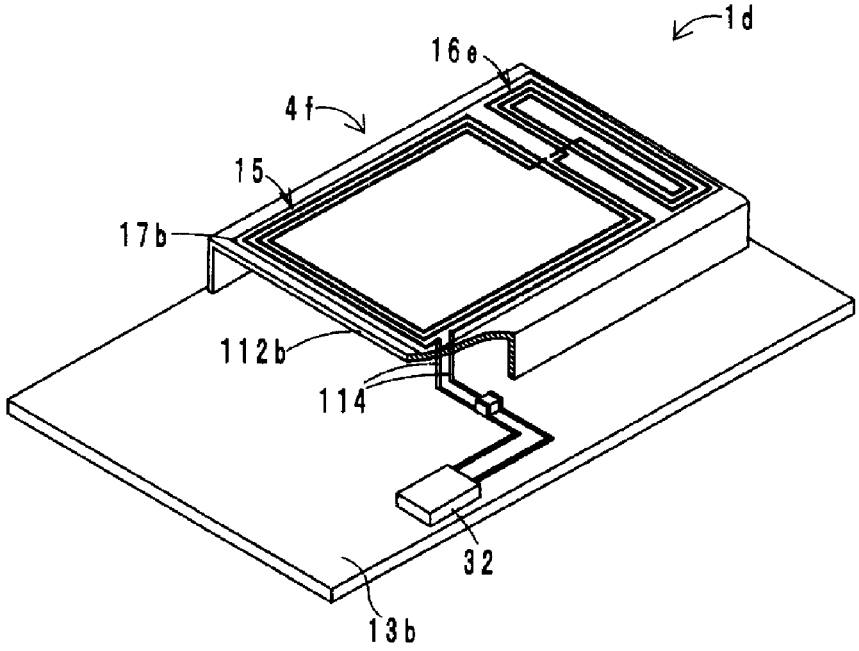
FIG. 15 is a schematic view illustrating another example of a specific location of the antenna device of FIGS. 13A and 13B.

In the example of FIG. 14, the main coil antenna 15 is connected to a feeding circuit, including the IC chip 32, through the FPC (Flexible Printed Circuit) connector 113. However, this is not a limitation. As illustrated in FIG. 15, the main coil antenna 15 may be connected to the feeding circuit, including the IC chip 32, through contact pins 114, such as spring pins.

Fifth Preferred Embodiment

Figure 16:
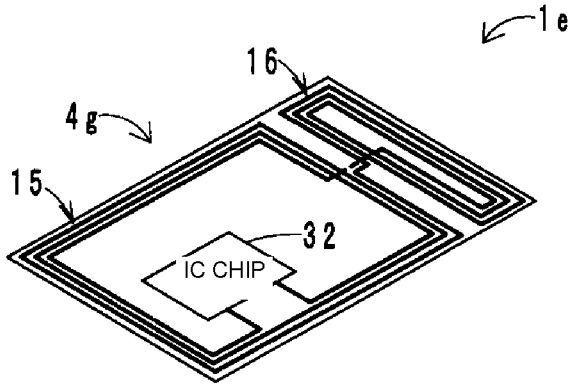
FIG. 16 is a perspective view illustrating a wireless communication apparatus (an antenna device) according to a fifth preferred embodiment of the present invention.

Next, referring to FIG. 16, a wireless communication apparatus 1*e* according to a fifth preferred embodiment of the present invention will be described. In FIG. 16, the wireless communication apparatus 1*e* preferably is a contactless IC card including the IC chip 32 and an antenna device 4*g*. The antenna device 4*g* includes the coil antenna 15 and the sub-coil antenna 16. The wireless communication apparatus 1*e* differs from the wireless communication apparatus 1*d* in the following respects. First, the coil antennas 15 and 16 preferably are both provided in the IC card. Second, the lengths of sides of the coil antennas 15 and 16 preferably are the same or substantially the same, and the lengths are slightly smaller than that of a side of the IC card. Third, the IC chip 32 preferably is disposed in the IC card and within the coil opening of the main antenna coil 15.

The wireless communication apparatus 1*e* is preferably used, for example, for the following applications. The wireless communication apparatus 1*e* is affixed to a cover of a book so that the sub-coil antenna 16 faces a spine of the book. By doing so, even when the book is stored in a bookshelf, the hot spot of the wireless communication apparatus 1*e* is moved toward the spine. Therefore, when a user brings a reader/writer close to the spine, the reader/writer performs data communication with the wireless communication apparatus 1*e*. When the book is taken out of the bookshelf, the reader/writer performs communication from the cover side. Therefore, it is not necessary to provide additional wireless communication apparatuses so as to enable data communication from different directions, including a direction from the spine side and a direction from the cover side.

As described above, the wireless communication apparatus 1*e* provides communication-enabled regions in two different directions, which are the in-plane direction and the normal direction of the main surface of the IC card.

In the preferred embodiments and the modifications described above, for example, as shown in FIG. 6, a capacitor preferably is connected in parallel to the feeding coil 31 at a position between the feeding circuit, including the IC chip 32, and the feeding coil 31, in order to obtain a predetermined resonant frequency. In addition to the capacitor, a matching circuit or a filter circuit preferably may be interposed between the feeding coil 31 and the feeding circuit. However, illustrations and descriptions of such a matching circuit and a filter circuit, which are not essential for the preferred embodiments and the modifications of the present invention, are omitted.

In the preferred embodiments, main coil antennas and sub-coil antennas having rectangular or substantially rectangular outer shapes preferably are used as examples. However, the outer shape of each of the coil antennas is not limited to a rectangular or substantially rectangular shape. The outer shape may be any shape, such as a circular or substantially circular shape, a partially concave shape, a non-rectangular polygonal shape, or the like.

For example, in the first preferred embodiment, in order to cause the feeding coil 31 and the sub-coil antenna 16 to be magnetically coupled to each other, the storage media 3 preferably is guided into the casing 11 by using the pair of guides 14, and then is fixed in place. However, this is not a limitation. It is sufficient that a guide is not present over the feeding coil 31 of the storage media 3, when the storage media 3 is inserted into the card insertion slot 12 and fixed in the casing 11. For example, a member including a pair of side surfaces and a top surface in which a cutout is provided at a position above the feeding coil may be used.

With the antenna device and the wireless communication apparatus according to various preferred embodiments of the present invention, flexibility regarding the disposition of an antenna coil is increased and a hot spot is capable of being provided at any desired positions. The antenna device and the wireless communication apparatus according to various preferred embodiments of the present invention are preferably used for an RFID tag or the like that performs short-range wireless communications in compliant with NFC, FeliCa (trademark), or the like.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a main coil antenna; and a sub-coil antenna connected to the main coil antenna; wherein the main coil antenna has an outer size larger than an outer size of the sub-coil antenna;

the main coil antenna and the sub-coil antenna are disposed so that a coil opening of the sub-coil antenna and a coil opening of the main coil antenna are arranged side by side in a plan view of the antenna device;

the main coil antenna and the sub-coil antenna are disposed so that outer edges of the main coil antenna and the sub-coil antenna are spaced apart by a predetermined distance, are wound so as to generate magnetic fields having opposite phases, and are coupled to each other through the magnetic fields;

a closed magnetic circuit is provided between the main coil antenna and the sub-coil antenna;

directions of current loops of the main coil antenna and the sub-coil antenna are opposite to each other;

a position of a hot spot of the antenna device is located outside of the main coil antenna when viewed along a winding axis of the main coil antenna; and a terminal electrode of the main coil antenna and a terminal electrode of the sub-coil antenna are electrically connected to each other and another terminal electrode of the main coil antenna and another terminal electrode of the sub-coil antenna are electrically connected to each other.

2. The antenna device according to claim 1, wherein the sub-coil antenna is magnetically coupled to a feeding coil connected to a feeding circuit.

3. The antenna device according to claim 1, further comprising a coupling coil connected to the main coil antenna, wherein the coupling coil is magnetically coupled to a feeding coil connected to a feeding circuit.

4. The antenna device according to claim 1, wherein the main coil antenna is magnetically coupled to a feeding coil connected to a feeding circuit.

5. The antenna device according to claim 1, wherein the main antenna coil is connected to a feeding circuit.

6. The antenna device according to claim 1, wherein the antenna device is configured to communicate using Near Field Communication.

7. The antenna device according to claim 1, wherein the position of the hot spot is located above a midpoint between the main coil antenna and the sub-coil antenna.

8. The antenna device according to claim 1, further comprising another sub-coil antenna connected to a side of the main coil antenna or a side of the sub-coil antenna, wherein a coil opening of the another sub-coil antenna and the coil opening of the main coil antenna are arranged side by side in the plan view of the antenna device such that the main coil antenna and the another sub-coil antenna are magnetically coupled to each other.

9. The antenna device according to claim 1, wherein each of the main coil antenna and the sub-coil antenna has an outer shape that is one of rectangular, substantially rectangular, circular, substantially circular, partially concave, and non-rectangular polygonal.

10. A wireless communication apparatus comprising:

a feeding circuit;

a main coil antenna connected to the feeding circuit; and a sub-coil antenna connected to the main coil antenna; wherein the main coil antenna has an outer size larger than an outer size of the sub-coil antenna;

the main coil antenna and the sub-coil antenna are disposed so that a coil opening of the sub-coil antenna and a coil opening of the main coil antenna are arranged side by side in a plan view of the wireless communication apparatus;

the main coil antenna and the sub-coil antenna are disposed so that outer edges of the main coil antenna and the sub-coil antenna are spaced apart by a predetermined distance, are wound so as to generate magnetic fields having opposite phases, and are coupled to each other through the magnetic fields;

a closed magnetic circuit is provided between the main coil antenna and the sub-coil antenna;

directions of current loops of the main coil antenna and the sub-coil antenna are opposite to each other;

a position of a hot spot of the antenna device is located outside of the main coil antenna when viewed along a winding axis of the main coil antenna; and a terminal electrode of the main coil antenna and a terminal electrode of the sub-coil antenna are electrically connected to each other, and another terminal electrode of the main coil antenna and another terminal electrode of the sub-coil antenna are electrically connected to each other.

11. The wireless communication apparatus according to claim 10, wherein the sub-coil antenna is magnetically coupled to a feeding coil connected to a feeding circuit.

12. The wireless communication apparatus according to claim 10, further comprising a coupling coil connected to the main coil antenna, wherein the coupling coil is magnetically coupled to a feeding coil connected to a feeding circuit.

13. The wireless communication apparatus according to claim 10, wherein the main coil antenna is magnetically coupled to a feeding coil connected to a feeding circuit.

14. The wireless communication apparatus according to claim 10, wherein the main antenna coil is connected to a feeding circuit.

15. The wireless communication apparatus according to claim 10, wherein the wireless communication device is configured to communicate using Near Field Communication.

16. The wireless communication apparatus according to claim 10, wherein the position of the hot spot is located above a midpoint between the main coil antenna and the sub-coil antenna.

17. The wireless communication apparatus according to claim 10, further comprising another sub-coil antenna connected to a side of the main coil antenna or a side of the sub-coil antenna, wherein a coil opening of the another sub-coil antenna and the coil opening of the main coil antenna are arranged side by side in the plan view of the antenna device such that the main coil antenna and the another sub-coil antenna are magnetically coupled to each other.

18. The wireless communication apparatus according to claim 10, wherein each of the main coil antenna and the sub-coil antenna has an outer shape that is one of rectangular, substantially rectangular, circular, substantially circular, partially concave, and non-rectangular polygonal.

19. The wireless communication apparatus according to claim 10, wherein the wireless communication apparatus is a cellular phone.

* * * * *